US006165660A

United States Patent [19]

Chambers et al.

[11] Patent Number: 6,165,660

[45] Date of Patent: Dec. 26, 2000

[54] ORGANIC PHOTORECEPTOR WITH IMPROVED ADHESION BETWEEN COATED LAYERS

[75] Inventors: John S Chambers, Rochester; Huoy-Jen Yuh, Pittsford; Robert E McCumiskey, Rochester, all of N.Y.

[73] Assignee: Xerox Corporation, Stamford, Conn.

[21] Appl. No.: 09/450,376

[22] Filed: Nov. 29, 1999

[51] Int. Cl.[7] ..... G03G 5/05

[52] U.S. Cl. ..... 430/56; 430/133; 427/430.1

[58] Field of Search ..... 430/133; 427/430.1, 427/435

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Byrne et al. | 260/314.5 |
| 3,442,781 | 5/1969 | Weinberger | 204/181 |
| 3,904,407 | 9/1975 | Regensberger et al. | 96/1.5 |
| 4,073,978 | 2/1978 | Womack et al. | 427/435 |
| 4,286,033 | 8/1981 | Neyhart et al. | 430/58 |
| 4,291,110 | 9/1981 | Lee | 430/59 |
| 4,338,387 | 7/1982 | Hewitt | 430/57 |
| 4,415,639 | 11/1983 | Horgan | 430/57 |
| 4,588,666 | 5/1986 | Stolka et al. | 430/59 |
| 4,855,203 | 8/1989 | Badesha et al. | 430/59 |
| 4,871,634 | 10/1989 | Limburg et al. | 430/54 |
| 5,077,093 | 12/1991 | Baumgartner et al. | 427/430.1 |
| 5,279,916 | 1/1994 | Sumino | 430/133 |
| 5,521,047 | 5/1996 | Yuh et al. | 430/134 |
| 5,709,974 | 1/1998 | Yuh et al. | 430/59 |
| 5,871,875 | 2/1999 | Chambers et al. | 430/133 |
| 5,891,594 | 4/1999 | Yuh et al. | 430/71 |

*Primary Examiner*—John Goodrow
*Attorney, Agent, or Firm*—Oliff & Berridge, PLC

[57] ABSTRACT

A process for forming an imaging member, includes providing an imaging member substrate, and applying at least a charge generating layer and a charge transport layer to the substrate, where at least one of the charge generating layer and the charge transport layer is applied from a coating solution in a dip coating process wherein a residence time of the substrate in the coating solution is greater than 1 second. The photoreceptor exhibits increased adhesion between the charge generating layer and the charge transport layer, as well as between other layers.

18 Claims, No Drawings

ORGANIC PHOTORECEPTOR WITH IMPROVED ADHESION BETWEEN COATED LAYERS

BACKGROUND OF THE INVENTION

1. Field of Invention

The present invention relates in general to electrophotography and, in particular, to a process for preparing electrophotographic imaging members or photoreceptors. The present invention provides a process for forming such imaging members, and imaging members formed thereby, having improved adhesion between coated layers.

2. Description of Related Art

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing electron donor molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

Suitable coating methods used for applying the various layers in electrophotographic imaging members include dip coating, roll coating, Meyer bar coating, bead coating, curtain flow coating and vacuum deposition. Solution coating is a preferred approach because it is more economical than vacuum coating and can be used to deposit a seamless layer.

U.S. Pat. No. 4,855,203 to Miyaka teaches applying charge generating layers from coating solutions comprising a resin dispersed pigment. Miyaka discloses suitable organic solvents for preparing a coating solution of the pigments as including alcohols such as methanol, ethanol and isopropanol; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane and ethylene glycol monomethyl ether; esters such as methyl acetate and ethyl acetate; aliphatic halogen hydrocarbons such as chloroform, methylene chloride, dichloroethylene, carbon tetrachloride and trichloroethylene; or aromatic compounds such as benzene, toluene, xylene, ligroin, monochlorobenzene and dichlorobenzene.

U.S. Pat. No. 3,904,47 to Regensburger et al. teaches applying perylene containing charge generating layers by a vacuum coating process. Vacuum coated charge generating layers containing perylenes show a high photosensitivity. However, vacuum coating is expensive.

U.S. Pat. No. 5,521,047 to Yuh et al. is directed to a process for preparing an electrophotographic imaging member having a perylene-containing charge generating layer from solution. The process comprises forming a dispersion of a perylene pigment and a polyvinylbutyryl binder in an acetate solvent and applying the dispersion to an electrophotographic imaging member layer by solution coating. Yuh et al. teaches that perylenes form stable dispersions in acetate solvents for the purposes of application by solvent coating such as dip coating.

U.S. Pat. No. 5,891,594 to Yuh et al. discloses a process for preparing an electrophotographic imaging member having a perylene-containing charge generating layer. The process includes the steps of dispersing a perylene-containing charge generating material in a solvent comprising n-butylacetate and a second solvent having a lower boiling point than n-butylacetate, wherein the second solvent is an acetate or tetrahydrofuran, and applying the dispersion to form the charge generating layer on a substrate or underlayer of the imaging member.

As described in the above-cited patents, solution coating is a more economical and convenient method of applying charge generating and charge transport layers than other of the known application methods. However, solution coating poses several problems that need to be overcome. For example, in the case of some particular charge generating materials such as perylene pigments, it may be difficult to disperse the materials in a coating solution, and unstable dispersions may be encountered when coating the materials from solution. Such unstable dispersions can cause pigment flocculating and settling that leads to coating quality problems. In addition, unstable dispersions are difficult to process, especially in a dip coating process. Further, some dip coated materials show a substantial depreciation in photosensitivity as compared to otherwise less preferred vacuum coated layers.

Furthermore, it is desired in the art to increase the adhesion between successive layers in an imaging member package. In particular, in the case of endless (seamless) belts, which tend to undergo much mechanical stress, increased adhesion of the successive layers in the imaging member is particularly desired.

Another problem with dip coating processes is that in some instances, the concentration of material to be coated can not be maintained at a desired level. For example, U.S. Pat. No. 5,709,974 discloses that, in the case of aromatic diamine charge transport coating materials, the maximum concentration of the aromatic diamine that can be dispersed in a binder is limited in a dip coating process due to the long residence time of the solvent before the drying step occurs. Thus, phase separation of the diamine can occur during the solvent resident time. Phase separation is undesirable because phase separation can result in poor charge transport including residual build, which adversely affects print quality.

SUMMARY OF THE INVENTION

The present invention is directed to a process for preparing an electrophotographic imaging member having at least a charge generating layer and a charge transport layer, with increased adhesion between the layers. The process comprises coating a charge generating layer on a substrate, and dip coating a charge transporting layer on the coated charge generating layer. During the dip coating process, the residence time of the substrate in the coating solution is increased over traditional dip coating methods, which has unexpectedly been found to increase adhesion between not only the charge generating layer and the charge transporting layer, but also between the charge generating layer and the substrate.

In particular, the present invention provides a process for forming an imaging member, comprising:

providing an imaging member substrate, and applying at least a charge generating layer and a charge transport layer to said substrate, wherein at least one of said charge generating layer and said charge transport layer is applied from a coating solution in a dip coating process wherein a residence time of said substrate in said coating solution is greater than 1 second.

In embodiments, the present invention also provides an imaging member comprising:

a substrate, a charge generating layer over said substrate, and a charge transport layer over said charge generating layer, wherein an adhesion value between the charge transport layer and the charge generating layer is at least 25 g/cm.

DETAILED DESCRIPTION OF PREFERRED EMBODIMENTS

The present invention relates to a method of forming a layer of an imaging member, such as a charge transport layer containing a charge transporting material, by a dip coating process. In the present invention, any suitable charge transporting material may be applied to a substrate (such as a supporting substrate previously coated with a charge generating layer or other layer of the photoreceptor). In the present invention, the residence time of the substrate in the dip coating solution is increased over traditional methods, so as to provide increased adhesion between the various respective layers.

According to embodiments of the present invention, an electrophotographic imaging member is provided, which generally comprises at least a substrate layer, a charge generating layer, and a charge transport layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by one or more coating processes, wherein at least one of the charge generating and charge transporting layers is formed by an improved dip coating technique as described herein.

In general, electrostatographic imaging members are well known in the art. An electrostatographic imaging member, including the electrostatographic imaging member of the present invention, may be prepared by any of the various suitable techniques, provided that at least one of the charge generating layer and charge transporting layer is formed by the improved dip coating technique of the present invention, which will be described below.

Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^2$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include film forming polymers, such as nylon, epoxy and phenolic resins. The polymeric blocking layer may also contain metal oxide particles, such as titanium dioxide or zinc oxide. The blocking layer may also include, but is not limited to, nitrogen containing siloxanes or nitrogen containing titanium compounds such as trimethoxysilyl propylene diamine, hydrolyzed trimethoxysilyl propyl ethylene diamine, N-beta (aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$ (gamma-aminopropyl)methyl diethoxysilane, mixtures thereof, and the like, as disclosed in U.S. Pat. Nos. 4,291,110, 4,338,387, 4,286,033 and 4,291,110, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 5 micrometer because greater thicknesses may lead to undesirably high residual voltage.

An optional adhesive layer may applied to the hole blocking layer. Any suitable adhesive layer well known in the art may be utilized. Typical adhesive layer materials include, for example, but are not limited to, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive or blocking layer, which in turn can then be overcoated with a contiguous hole (charge) transport layer as described hereinafter. Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Of course, thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member formed by the process of the present invention generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight binder, between about 27 percent and about 3 percent by weight charge transport material, and between about 64 percent and about 85 percent by weight solvent for dip coating applications. Drying of the deposited coating may be effected by any suitable conventional technique such as oven drying, infra-red radiation drying, air drying and the like.

Generally, the thickness of the charge transport layer is between about 10 and about 50 micrometers, but thickness outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

However, according to the present invention, the charge transport layer coating mixture is particularly applied using a modified dip coating method. Traditional dip coating techniques are known in the art. See, for example, Chapter 13 of Schunk, Hurd and Brinker, *Liquid Film Coating*, Chapman and Hall 1997, the entire disclosure of which is incorporated herein by reference. However, according to the present invention, the traditional dip coating process is modified so as to increase the residence time of the substrate in the coating solution, prior to withdrawing the substrate from the coating solution to coat the substrate.

Any suitable dip (or immersion) process may be employed for preparing the electrophotographic imaging member of this invention. In this dip coating process, the coating mixture is normally retained in a dip or immersion coating vessel, and the substrate to be coated and/or the vessel may be moved relative to each other. Thus, the substrate may be moved relative to the vessel, the vessel may be moved relative to the substrate, or both may be moved relative to each other. Generally, movement of the substrate and/or the vessel are effected in a vertical direction to perform the dip or immersion processing.

According to traditional dip coating processing, the substrate is dipped into the coating solution in the coating vessel to a desired level of submersion. Next, the substrate is slowly or quickly withdrawn from the vessel, causing the coating solution to adhere to and thereby coat the substrate. Generally, the withdrawal speed is selected to obtain a desired coating thickness and/or quality. In such traditional dip coating methods, the residence time of the substrate in the coating solution is minimal, such as five seconds or less or even one second or less, i.e., the substrate is withdrawn from the coating solution immediately after being immersed therein.

According to the methods of the claimed invention, however, the substrate is not immediately withdrawn from the coating solution. Rather, the substrate is retained in the coating solution prior to withdrawal for a set period of time (residence time). As used herein, "residence time" refers to the time period during which an entire desired coating portion of the substrate is in the coating solution, i.e., from when insertion of the substrate into the coating solution stops, until withdrawal of the substrate from the coating solution starts. Thus, residence time does not include the time during the insertion and withdrawal steps during which a portion of the substrate is in contact with the coating solution. It has unexpectedly been found that, by providing this longer residence time, successive layers of the photoreceptor have increased adhesion to each other. For example, where this modified dip coating process is used to apply a charge transport layer, increased adhesion can be realized not only between the charge transport layer and the charge generating layer, but also between the charge generating layer and an underlying undercoat layer.

According to the present invention, the residence time of the substrate in the coating solution, prior to starting withdrawal of the substrate therefrom, is from about 1 second to about 1 hour. Preferably, the residence time of the substrate in the coating solution is from about 5 seconds to about 30 minutes, more preferably from about 10 seconds to about 10 minutes or 20 minutes, and even more preferably from about 15 seconds to about 5 minutes. Particularly acceptable results are obtained with a residence time of from about 5 or 15 seconds to about 60 seconds, preferably 15 or 30 seconds to about 60 seconds. Of course, other residence times can be used, as desired, and may be dependent upon the particular coating solution and/or substrate being used.

In embodiments of the present invention, the residence time of the substrate in the coating solution is sufficient to provide increased adhesion, such as between the charge generating layer and the charge transport layer, without causing cohesive failure. In embodiments of the present invention where the modified dip coating method is used to apply a charge transport layer to a charge generating layer, the process of the present invention can provide adhesion values between the charge transport layer and the charge generating layer of at least 25 g/cm, preferably at least 30 g/cm, more preferably at least 35 g/cm. Similarly, in such embodiments, the process of the present invention can provide adhesion values between the charge generating layer and an underlying layer, such as a blocking layer, of at least 20 g/cm, preferably at least 30 g/cm, more preferably at least 50 g/cm.

According to the present invention, the residence time can be adjusted to be any time from zero seconds, to the time that results in cohesive failure between the respective layers of the imaging member. Preferably, therefore, the residence time is adjusted so as to provide increased adhesion, without resulting in cohesive failure.

Generally, a longer residence time provides increased adhesion between adjoining layers of the photoreceptor. Although not limited to this particular theory, it is believed that the increased adhesion results from an interdiffusion of materials from the adjoining layers into each other. Thus, for example, as the residence time increases, the boundary layer between adjoining layers becomes less clear.

An optional overcoat layer may be applied over the charge transport layer. The overcoat layer may comprise, for example, a dihydroxy arylamine dissolved or molecularly dispersed in a polyamide matrix. The overcoat layer may be formed from a coating composition comprising an alcohol soluble film forming polyamide and a dihydroxy arylamine.

In these embodiments, any suitable alcohol soluble polyamide film forming binder capable of forming hydrogen bonds with the hydroxy functional materials may be utilized in the overcoating. The expression "hydrogen bonding" is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide utilized in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent, which also dissolves the hole transporting small molecule having multi hydroxy functional groups. The polyamides polymers required for the overcoatings are characterized by the presence of amide groups, —CONH. Typical polyamides include the various Elvamide resins, which are nylon multipolymer resins, such as alcohol soluble Elvamide and Elvamide TH Resins. Elvamide resins are available from E. I. Dupont Nemours and Company. Other examples of polyamides include Elvamide 8061, Elvamide 8064, and Elvamide 8023. One class of alcohol soluble polyamide polymer is disclosed in U.S. Pat. No. 5,709,974, the entire disclosure of which is incorporated herein by reference.

The polyamide should also be soluble in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd., and other N-methoxymethylated polyamides, such as those prepared according to the method described in Sorenson and Campbell "Preparative Methods of Polymer Chemistry" second edition, pg 76, John Wiley & Sons Inc. 1968, and the like, and mixtures thereof. Other polyamides are Elvamides from E. I. Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, and the sensitivity of the overcoated photoreceptor. To overcome this, the overcoating of this invention also includes a dihydroxy arylamine, as disclosed in U.S. Pat. Nos. 5,709,974, 4,871,634 and 4,588,666, the entire disclosures of which are incorporated herein by reference.

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

The photoreceptors of the present invention may comprise, for example, a charge generator layer sandwiched between a conductive surface and a charge transport layer, as described above, or a charge transport layer sandwiched between a conductive surface and a charge generator layer. This structure may be imaged in the conventional xerographic manner, which usually includes charging, optical exposure and development.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques may be utilize to form and develop electrostatic latent images on the imaging member of this invention. Thus, for example, conventional light lens or laser exposure systems may be used to form the electrostatic latent image. The resulting electrostatic latent image may be developed by suitable conventional development techniques such as magnetic brush, cascade, powder cloud, and the like.

Furthermore, although the invention has been described above in respect to a particular embodiment where the modified dip coating process is used to apply a charge transport layer to a charge generator layer-coated substrate, the invention is not limited to this embodiment. In particular, the modified dip coating process can be used to apply any or all of the various layers, which are susceptible to dip coating processing. Thus, for example, the modified dip coating process of the present invention can be used to apply any or all of the undercoating layer, the charge generating layer, the charge transporting layer, one or more adhesive layers, and an overcoating layer.

Furthermnore, for example in embodiments where the charge transport layer is applied previous to a charge generating layer, the charge transport layer can be applied by convention processes, and the charge generating layer can be applied by the modified dip coating method of the claimed invention. This processing thereby provides increased adhesion not only of the charge generating layer to the adjoining charge transport layer, but also of the charge transport layer to an underlying substrate or undercoating layer.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

An example is set forth hereinbelow and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example 1

An electrophotographic imaging member is prepared. The imaging member includes a nickel substrate, a blocking layer, a charge generating layer, and a charge transport layer. The blocking layer is coated using a solution of Luckamide (a polyamide film forming polymer available from Dai Nippon Ink) in a mixture of methanol, butanol and water, at 55, 36 and 9 parts by weight. The blocking layer is applied at a thickness of 1.0 micrometer, and is dried at 145° C. for 10 minutes. The charge generating layer is coated using a solution of 9.6 parts by weight benzimidazole perylene in 14.4 parts by weight B79 (a polyvinylbutyral available from Monsanto Chemical Co.) in 76 parts by weight cyclohexanone. The charge generating layer is dried at 106° C. for 10 minutes. The dried charge generator layer thickness is about 0.2 micrometer. The charge transporting layer is coated using a solution of a mixture of PCZ400 (a polycarbonate) and mTBD (N,N'-diphenyl-N,N'-bis[3-methylpropyl]-[1,1'-biphenyl]-4,4'-diamine) in monochlorobenzene. The charge transporting layer is dried at 118° C. for 45 minutes.

Each of the blocking layer and the charge generating layer is applied using a conventional dip coating method with no residence time. That is, withdrawal of the substrate from the coating solution is begun immediately after completion of insertion. The charge transporting layer is applied by the modified dip coating method of the present invention, with a residence time of 30 seconds.

Following completion of the imaging member, the interfacial adhesion between the respective layers is determined using an Instrumentors Inc., Slip Peal Tester Model 3M90 in normal peal mode. The adhesion data is presented in Table I below.

Example 2

An electrophotographic imaging member is prepared according to the procedures of Example 1, except that the residence time of the substrate in the charge transport coating solution is changed from 30 seconds to 60 seconds. The adhesion data is presented in Table I below. Table I indicates that cohesive failure occurred in the imaging member of this Example. In particular, the charge generating layer exhibits cohesive failure, indicated by breaks within the layer during the peel test.

Comparative Example 1

An electrophotographic imaging member is prepared according to the procedures of Example 1, except that the residence time of the substrate in the charge transport coating solution is changed from 30 seconds to 0 seconds, i.e., no residence time according to traditional dip coating procedures. The adhesion data is presented in Table I below.

TABLE I

| Example | Residence Time (seconds) | Blocking Layer-Generating Layer Adhesion (g/cm) | Generating Layer-Transport Layer Adhesion (g/cm) |
|---|---|---|---|
| 1 | 30 | 160 | 38 |
| 2 | 60 | >200 (cohesive failure) | >38 (cohesive failure) |
| Comp 1 | 0 | — | 23 |

As is apparent from the results in Table I, the dip coating process of the present invention provides increased adhesion between the layers of the photoreceptor. These results unexpectedly occur based on the increased residence time of the substrate in the coating solution.

What is claimed is:

1. A process for forming an imaging member, comprising:

providing an imaging member substrate, and applying at least a charge generating layer and a charge transport layer to said substrate, wherein at least one of said charge generating layer and said charge transport layer is applied from a coating solution in a dip coating process wherein a residence time of said substrate in said coating solution is greater than 5 seconds, and wherein said residence time provides an adhesion value between the charge transport layer and the charge generating layer of at least 25 g/cm.

2. The process according to claim 1, wherein said residence time is from about 5 seconds to about 1 hour.

3. The process according to claim 1, wherein said residence time is from about 5 seconds to about 60 seconds.

4. The process according to claim 1, wherein said residence time is effective to increase adhesion between said charge generating layer and said charge transport layer.

5. The process according to claim 4, wherein said residence time is effective to not cause cohesive failure between said charge generating layer and said charge transport layer.

6. The process according to claim 1, wherein said residence time provides an adhesion value between the charge transport layer and the charge generating layer of at least 30 g/cm.

7. The process according to claim 1, wherein said dip coating process is used to apply said charge transport layer.

8. The process according to claim 7, wherein first said charge generating layer is applied to said substrate, and then said charge transport layer is applied to said charge generating layer.

9. The process according to claim 1, wherein said dip coating process is used to apply said charge generating layer.

10. The process according to claim 1, wherein said dip coating process is used to apply both said charge generating layer and said charge transport layer.

11. An imaging member made by the process of claim 1.

12. The imaging member of claim 11, wherein an adhesion value between the charge transport layer and the charge generating layer of at least 30 g/cm.

13. The imaging member of claim 11, wherein said charge generating layer is located between said substrate and said charge transport layer.

14. The imaging member of claim 13, wherein an adhesion value between the charge generating layer and an underlying layer is at least 20 g/cm.

15. The imaging member of claim 13, wherein an adhesion value between the charge generating layer and an underlying layer is at least 30 g/cm.

16. The imaging member of claim 14, further comprising a blocking layer between said substrate and said charge generating layer, and said blocking layer is said underlying layer.

17. An imaging member comprising:

a substrate, a charge generating layer over said substrate, and a charge transport layer over said charge generating layer, wherein an adhesion value between the charge transport layer and the charge generating layer is at least 25 g/cm.

18. The imaging member of claim 17, further comprising a blocking layer between said substrate and said charge generating layer, and an adhesion value between the charge generating layer and the blocking layer is at least 20 g/cm.

* * * * *